US008371993B2

(12) United States Patent
Brown et al.

(10) Patent No.: US 8,371,993 B2
(45) Date of Patent: Feb. 12, 2013

(54) QUICK DEPLOY DRAG CHUTE

(75) Inventors: Jonathan Ira Brown, Portland, OR (US); William M. Dieter, Portland, OR (US); Susanna Marie Hohmann, Portland, OR (US)

(73) Assignee: Nike, Inc., Beaverton, OR (US)

( * ) Notice: Subject to any disclaimer, the term of this patent is extended or adjusted under 35 U.S.C. 154(b) by 219 days.

(21) Appl. No.: 12/837,247

(22) Filed: Jul. 15, 2010

(65) Prior Publication Data

US 2012/0015783 A1 Jan. 19, 2012

(51) Int. Cl.

| | |
|---|---|
| ***A63B 71/00*** | (2006.01) |
| ***A63B 21/008*** | (2006.01) |
| ***B64D 17/00*** | (2006.01) |
| ***B64D 19/00*** | (2006.01) |
| ***B64D 21/00*** | (2006.01) |
| ***B64D 23/00*** | (2006.01) |

(52) U.S. Cl. ..... 482/74; 482/111; 244/142

(58) Field of Classification Search ..... 482/14, 482/51, 55–56, 74, 92, 111, 131, 139, 148; 244/113, 142, 145, 147–148; 280/213, 810; 114/311; 446/34, 49–53

See application file for complete search history.

(56) References Cited

U.S. PATENT DOCUMENTS

| | | | | |
|---|---|---|---|---|
| 2,505,954 | A * | 5/1950 | Frieder et al. | 244/145 |
| 5,217,186 | A * | 6/1993 | Stewart et al. | 244/142 |
| 5,460,589 | A * | 10/1995 | Dunn | 482/111 |
| 5,472,394 | A * | 12/1995 | Michaelson | 482/74 |
| 6,099,041 | A * | 8/2000 | Carter | 280/810 |
| 2003/0207738 | A1 * | 11/2003 | Wong | 482/74 |
| 2008/0161167 | A1 * | 7/2008 | Ottaviani | 482/55 |

OTHER PUBLICATIONS

Running Parachute, http://www.blitzsport.com/Running-Parachute, May 10, 2010, 1 page.*

* cited by examiner

*Primary Examiner* — Oren Ginsberg
(74) *Attorney, Agent, or Firm* — Shook, Hardy & Bacon L.L.P.

(57) ABSTRACT

Embodiments relate to a drag chute. An exemplary drag chute is comprised of a canopy from flexible material having a perimeter, a first surface, and a second surface. The drag chute is also comprised of a stiffening member coupled to the canopy along a portion of the canopy perimeter. The drag chute is also comprised of a veil attached to the canopy and a leash attached to the veil. The stiffening member may be maintained in a tunnel that extends along at least a portion of the canopy perimeter. In an additional embodiment, the stiffening member may be a foam material. An additional embodiment may include an integrated bag for storing one or more parts of the drag chute when not in use.

17 Claims, 6 Drawing Sheets

QUICK DEPLOY DRAG CHUTE

BACKGROUND

Drag chutes are a resistance training device used by athletes. A drag chute typically includes a canopy that relies on a pressure differential between a windward side of the canopy and a leeward side of the canopy to generate a force that opposes movement of the athlete. A drag chutes is deployed when the pressure differential between the windward side and the leeward side is generated. However, deployment of a drag chute may be hindered when the windward side of the canopy is limited or restricted from being exposed to an apparent wind. This restriction may be a result of a flexible canopy folding over onto itself causing an intended leeward side of the canopy to be exposed to the apparent wind, which may interfere with proper deployment.

Drag chutes are typically used to produce resistance in a running exercise. The running exercise may be a sprint or other short distance movement. Therefore, an athlete may desire an attached drag chute to deploy as soon as possible from an initial movement in the running exercise. Consequently, tardiness or even failure of a drag chute to deploy prevents the athlete from receiving the full benefits expected from a drag chute.

SUMMARY

Embodiments of the present invention relate to a drag chute. An exemplary drag chute has a canopy of flexible material having a perimeter, a first surface, and a second surface. The drag chute also is comprised of a stiffening member coupled to the canopy along a portion of the canopy perimeter. The drag chute is also comprised of a veil attached to the canopy and a leash attached to the veil.

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter.

BRIEF DESCRIPTION OF THE SEVERAL VIEWS OF THE DRAWINGS

Illustrative embodiments of the present invention are described in detail below with reference to the attached drawing figures, which are incorporated by reference herein and wherein.

DETAILED DESCRIPTION

Figure 1:
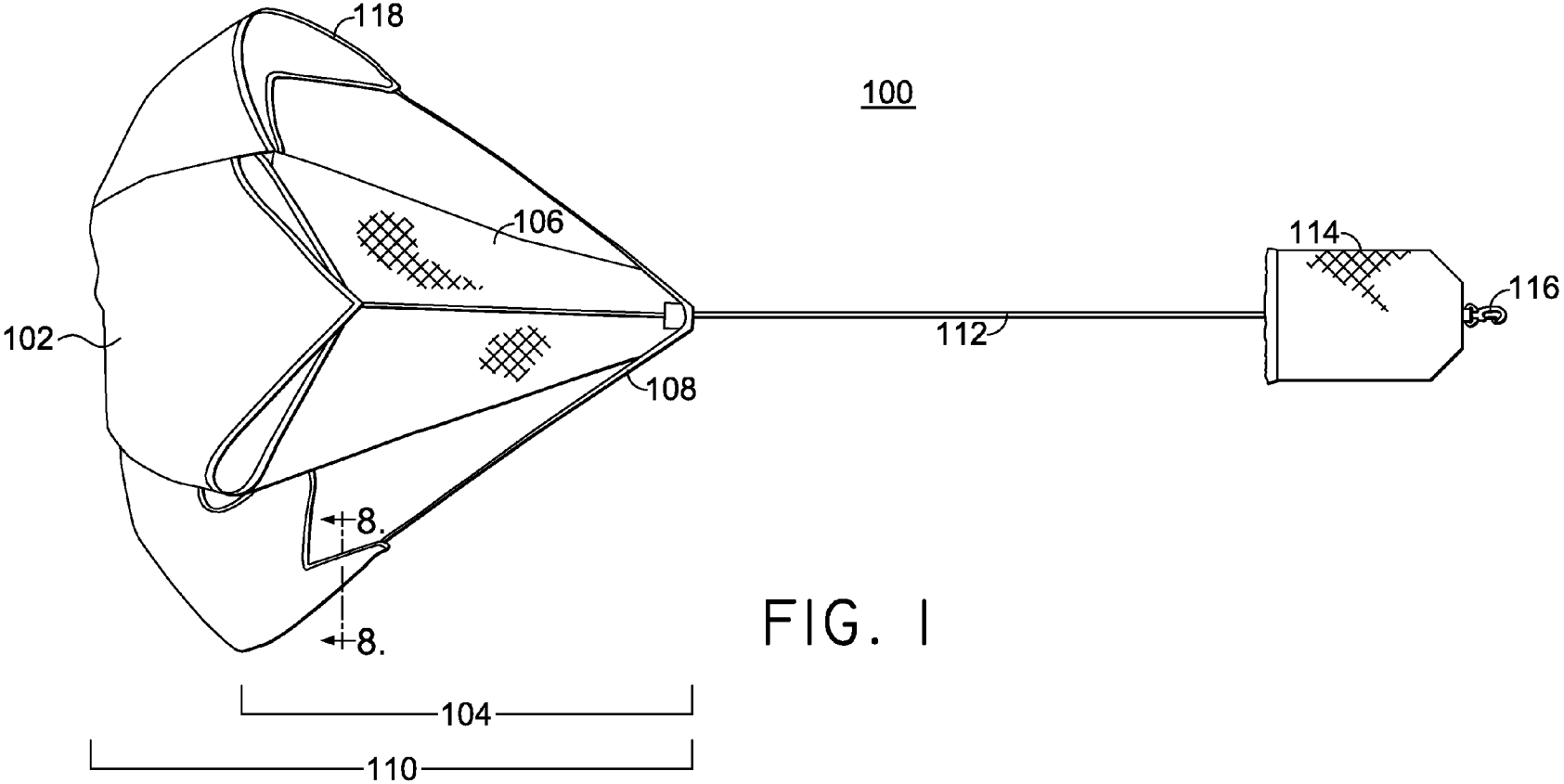
FIG. 1 depicts an exemplary drag chute in accordance with embodiments of the present invention.

The subject matter of embodiments of the present invention is described with specificity herein to meet statutory requirements. However, the description itself is not intended to limit the scope of this patent. Rather, the inventors have contemplated that the claimed subject matter might also be embodied in other ways, to include different features or combinations of features similar to the ones described in this document, in conjunction with other present or future technologies.

Embodiments of the present invention relate to a drag chute. An exemplary drag chute has a canopy of flexible material, a stiffening member coupled to the canopy along a portion of the canopy perimeter, a veil attached to the canopy, and a leash attached to the veil.

Accordingly, in one aspect, the present invention provides a drag chute comprised of a canopy of flexible material having a perimeter, a first surface, and a second surface. The drag chute also is comprised of a stiffening member coupled to the canopy along a portion of the canopy perimeter. The drag chute is also comprised of a veil attached to the canopy and a leash attached to the veil.

In another aspect, the present invention provides another embodiment of a drag chute. The drag chute is comprised of a canopy of flexible material having a perimeter defined by a stiffening tunnel. The drag chute is further comprised of a stiffening member maintained within the stiffening tunnel of the canopy perimeter. Additionally, the drag chute is comprised of a veil coupled to the canopy. The drag chute may also be comprised of a bag and a leash. The leash has a first end and a second end. The leash is coupled to the bag proximate the first end. The leash is coupled to the canopy proximate the second end. And, the leash is coupled to the veil along a portion of the leash between the first end and the second end.

A third aspect of the present invention provides another drag chute. The drag chute is comprised of a canopy of flexible material having a windward side, a leeward side, and a perimeter comprised of a stiffening member tunnel. The drag chute is further comprised of a stiffening member maintained in the stiffening member tunnel of the canopy; the stiffening member is a foam material. The drag chute is further comprised of a veil comprised of a first swept wing portion, a second swept wing portion, a first veil webbing portion, and a second veil webbing portion. The first swept wing portion, the second swept wing portion, the first veil webbing portion, and the second veil webbing portion are each coupled to the canopy. The drag chute is further comprised of a bag having an open end, a closed end, and an internal cavity between the closed end and the open end. The drag chute is also comprised of a connecting member. Further, the drag chute is comprised of a leash having a first end coupled to the canopy, a second end coupled to the connecting member, and a leash portion between the first end and the second end coupled to the veil. The leash extends through the internal cavity of the bag from the closed end of the bag through the open end of the bag to the veil and the canopy.

Having briefly described an overview of embodiments of the present invention, an exemplary drag chute suitable for implementing embodiments hereof is described below.

Referring to the drawings in general, and initially to FIG. 1 in particular, an exemplary drag chute 100 is illustrated in accordance with embodiments of the present invention. The drag chute 100 is pulled or towed by an athlete to generate resistance opposing the direction of movement of the athlete. For example, a sprinter may attach a drag chute to his or her waist and sprint on a track. The drag chute, while connected to the sprinter, opposes the forward movement of the sprinter inducing a force that the sprinter must overcome. The force created by a drag chute is a function of at least the speed of the apparent air (i.e., the speed in which the windward side of the chute travels through the air) to the drag chute and the surface area exposed to the air. Other factors may also affect the force (e.g., turbulence of the air, density of the air, geometry of the chute, etc.)

The drag chute 100, unlike a traditional parachute, generally operates in a direction parallel to the ground. This is contrary to a traditional parachute that is employed to resist a downward movement of an attached object (e.g., cargo, person). Therefore, different structural demands exist between a parachute and a drag chute. Both a parachute and a drag chute "capture" air within an envelope of the chute to produce an area of high pressure that resists movement in the windward direction. However, a parachute is exposed to gravitational effects in the same direction as movement. This is fundamentally different from a drag chute that experiences gravity from a different orientation than a direction of movement (e.g., a track in which a sprinter may run is generally perpendicular to the direction of gravity; therefore, the drag chute experiences a vertical force from gravity and a lateral force from the sprinter's movement).

The unparallel nature of the force of gravity (e.g., down) and the force of air pressure (e.g., horizontal) may cause a drag chute to slowly deploy. For example, the drag chute 100 is "deployed" when a canopy 102 has a windward side that has an area of higher pressure than a leeward side. A difference in air pressure from a first surface of the drag chute 100 to a second surface of the drag chute 100 creates the appearance of the drag chute 100 being "filled" with air. As used herein, a windward surface is a surface experiencing (e.g., into) the apparent wind. Apparent wind is the direction of wind as experienced by the drag chute 100. For example, if a 2 knot wind is blowing from east to west and the drag chute is traveling at 5 knots from west to east, the apparent wind experienced by the windward surface of the drag chute is 7 knots. Using this same example, if the wind continues to blow at 2 knots from east to west, but the drag chute is now traveling from east to west (i.e., the same direction as the current wind) at 5 knots, the apparent wind experienced by the drag chute is 3 knots. Therefore, a drag chute is deployed by creating an area of higher pressure on the windward side than the leeward side of the canopy.

A drag chute may be slow to deploy when the windward surface fails to be exposed to the apparent wind. As a result, the pressure differential between the windward and the leeward side (i.e. surface) of the canopy may not occur. Commonly, the windward surface fails to be exposed to the apparent wind when a portion of the intended leeward side of the canopy maintains an orientation into the apparent wind. For example, a square canopy may fold over onto itself when at rest (e.g., no apparent wind) due to the effects of gravity. Therefore, when the apparent wind increases (e.g., forward movement of the drag chute) a pressure differential between the intended windward side and the intended leeward side of the canopy fails to materialize to an adequate extent.

Therefore, embodiments of the present invention resist some of the effects of gravity by employing a stiffening member along a perimeter of a drag chute. In an exemplary embodiment, the stiffening member assists a canopy to "open" resulting in a pressure differential between the windward and leeward sides of a drag chute. For example, when an exemplary drag chute is at rest, a stiffening member counters at least some of the experienced gravitational forces to maintain a separation between two perimeter edges (e.g., top and bottom edges when the drag chute is at rest) of the drag chute. This separation between two edges allows apparent wind to be experienced by a windward surface of the drag chute to facilitate deployment. Additionally, a stiffening member, in an exemplary embodiment, helps maintain a drag chute in a deployed state when forces (e.g., gravity, wind, veil) acting on an edge (e.g., upper) are greater than a force generated by the canopy in an opposite direction (e.g., air pressure keeping an upper edge of the drag chute up). In this example, a stiffening member may add additional counteracting forces that allow the canopy to maintain a deployed state.

Figure 2:
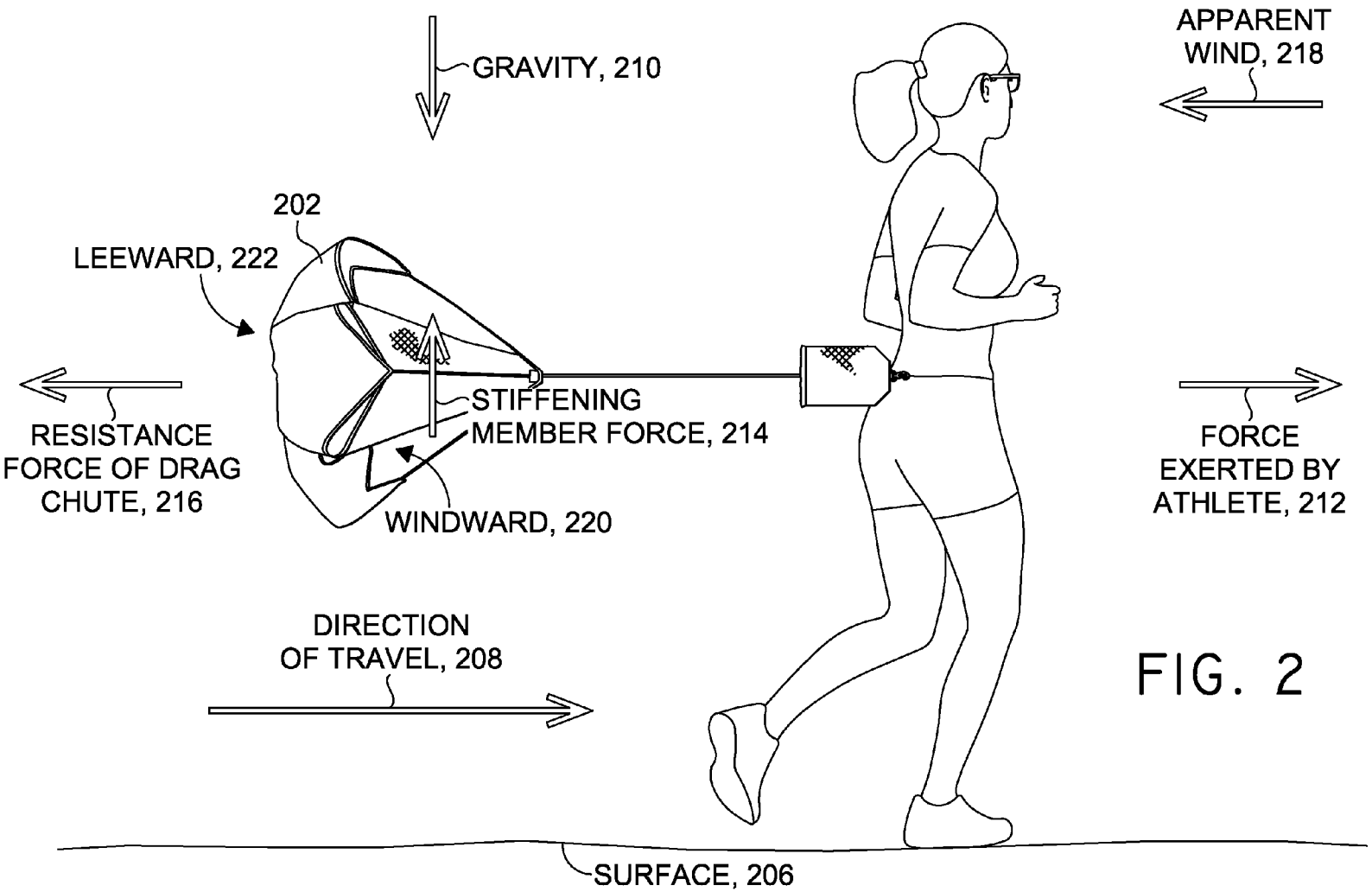
FIG. 2 depicts a drag chute force diagram in accordance with embodiments of the present invention.

Briefly turning to FIG. 2 that depicts a drag chute 202 force diagram 200 in accordance with embodiments of the present invention. The drag chute is attached to an athlete 204. The athlete 204 is moving along a surface 206 (e.g., field, track) in a direction of travel 208. As the athlete 204 moves in the direction of travel 208, the athlete exerts a force 212 in the direction of travel 208. Consequently, the drag chute 202 (as well as the athlete 204) experiences an apparent wind 218. The apparent wind 218 creates a pressure differential between a windward side 220 and a leeward side 222 of the chute 202. The pressure differential includes a higher pressure on the windward side 220 than the leeward side 222. The pressure differential provides a resistance force 216 that is opposite the force exerted by the athlete 212.

However, in this example, a gravitational force 210 resists the opening of the drag chute 202. To counteract the gravitational force 210, a stiffening member may be implemented within the drag chute 202 to provide a stiffening member force 214. Consequently, in this example, when the drag chute is at rest or even in motion, the stiffening member force 214 aids in presenting the windward side 220 of the drag chute 202 to the apparent wind 218. It is contemplated that a stiffening member may provide a stiffening member force, such as the stiffening member force 214, in any direction and at any magnitude. For example, a stiffening member force may exert force in any direction outward from a canopy.

While the examples herein have discussed a stiffening member counteracting a gravitational force, it is understood that a stiffening member may counteract any force. For example, a veil of the drag chute 202 may provide an angular force the attempts to bring at least two perimeter edges of the drag chute 202 canopy together. A stiffening member may be effective for countering at least a portion of a force generated by the veil. Other forces to counter are also contemplated herein.

Figure 8:
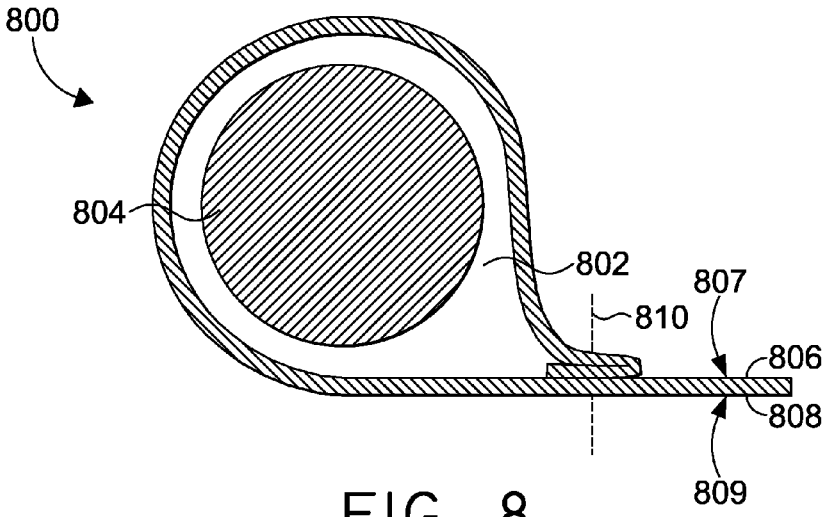
FIG. 8 depicts an exemplary stiffening member tunnel cross section view in accordance with embodiments of the present invention.

Returning to FIG. 1, the canopy 102, in an exemplary embodiment, is a flexible nylon material. The nylon material of the canopy 102, in this example, may be coated on one or both sides. For example a urethane coating may be applied to one or both sides of the canopy, as depicted in FIG. 8 as a first urethane coating 807 and a second urethane coating 809. The urethane coating, among other benefits, may provide wear resistance and/or decrease porosity (e.g., air transmission from a windward side to a leeward side) of the canopy 102.

The drag chute 100 is further comprised of a veil 104. The veil 104 is comprised of a swept wing portion 106 and a veil webbing portion 108. In additional exemplary embodiments, a veil is comprised of the veil webbing portion 108 or the swept wing portion 106 individually. Further, it is contemplated that the veil webbing portion 108 is any connecting member (e.g., cord, rope, webbing, string, fabric, etc.) Therefore, a parachute portion 110 of the drag chute 100 is comprised of the veil 104 and the canopy 102. Further, the drag chute 100 is comprised of a leash 112, a bag 114, and a connecting member 116.

In an exemplary embodiment of the present invention, the canopy 102 is coupled to the swept wing portion 106 and the veil webbing 108. The geometry (i.e., size and shape) and coupling locations of the canopy 102 and the veil 104 components define a deployed geometry of the parachute 110. In an exemplary embodiment, the leash 112 is coupled to the canopy 102. Further, in an exemplary embodiment, the leash 112 is coupled to the veil 104. For example, the leash 112 may be couple to the veil webbing 108 and/or the swept wing portion 106.

As will be explained in greater detail hereinafter, the leash 112 may extend though an internal cavity of the bag 114 by passing through an open end of the bag 114 to a closed end of the bag 114. The leash 112 may then be terminated by a connecting member 116. For example, the connecting member 116 may be affixed to the bag 114 and the leash 112 allowing a transfer of force from an athlete to the parachute 110.

The drag chute 100 is also comprised of a stiffening member tunnel 118. The stiffening member tunnel 118 is a cavity for maintaining a stiffening member along a perimeter of the canopy 102. As will be discussed in more detail at FIG. 8, the stiffening member tunnel 118 may be constructed, in an embodiment, by securing an edge portion of the canopy 102 to the canopy itself. In essence, a traditional cuff may be formed by a similar process. As depicted in this exemplary embodiment, the stiffening member tunnel 118 is along the entire perimeter of the canopy 102. However, it is contemplated that only a portion of the perimeter (i.e. outer edge) constitutes a stiffening member tunnel. Additionally, it is contemplated herein that a stiffening member tunnel is not implemented in embodiments of the present invention. Instead, a stiffening member may be coupled directly to the canopy 102 by other systems. For example, a stiffening member may be adhered, tacked, sewn, snapped, buttoned, compressed, and/or the like to couple a stiffening member to the canopy.

Many different arrangements of the various components depicted in FIG. 1, as well as components not shown, are possible without departing from the spirit and scope of the present invention. Embodiments of the present invention have been described with the intent to be illustrative rather than restrictive. Alternative embodiments will become apparent to those skilled in the art that do not depart from its scope. A skilled artisan may develop alternative means of implementing the aforementioned improvements without departing from the scope of the present invention.

Figure 3:
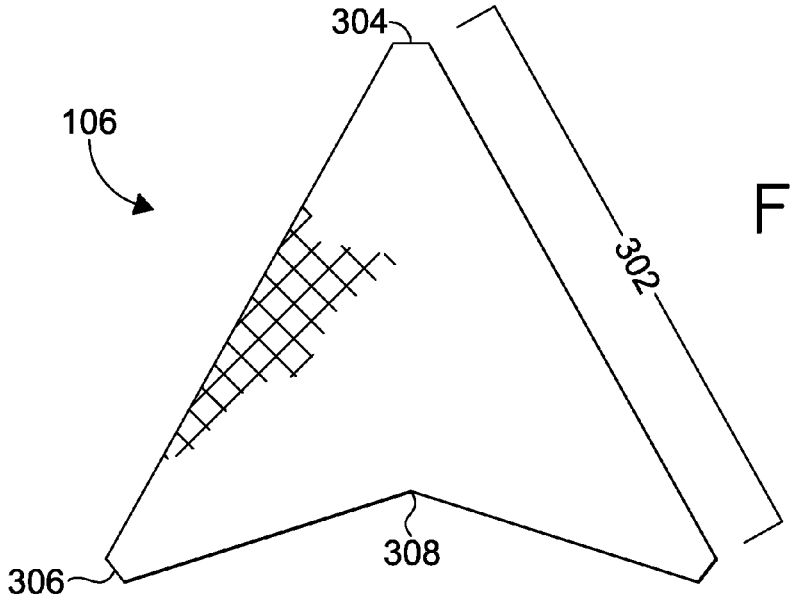
FIG. 3 depicts a swept wing portion in accordance with embodiments of the present invention.

FIG. 3 depicts a swept wing portion 106 in accordance with embodiments of the present invention. The swept wing portion 106 has a proximal end 304. The proximal end 304 is closer to an athlete in an as-worn position. The swept wing 106 has a lateral distal end 306 and a medial distal end 308. The proximal end 304 and the medial distal end 308 define an axis (apparent wind axis) that is parallel to an apparent wind in an exemplary embodiment. A length defined from the proximal end 304 to the lateral distal end 306 is a length 302. In an exemplary embodiment, the swept wing portion 106 is a flexible material, such as nylon.

Figure 4:
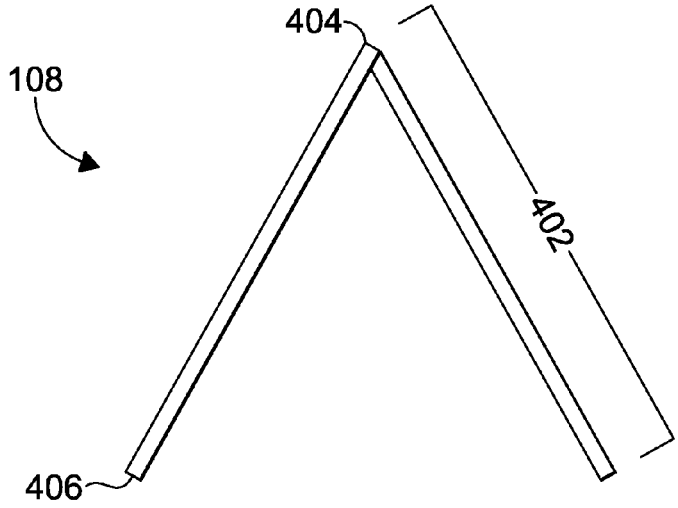
FIG. 4 depicts a veil webbing portion in accordance with embodiments of the present invention.

FIG. 4 depicts a veil webbing portion 108 in accordance with embodiments of the present invention. The veil webbing portion 108 is defined by a proximal end 404 and a distal end 406. In an exemplary embodiment, the veil webbing 108 is nylon webbing. For example, a ½ inch nylon webbing material is contemplated. In an exemplary embodiment, a unitary piece of webbing is used to form a V-shaped webbing portion where the proximal end 404 defines a point of the V-shaped webbing portion. A length defined from the proximal end 404 to the lateral end 406 is a length 402.

In an exemplary embodiment, the length 302 of FIG. 3 is greater than the length 402 of FIG. 4. For example, a ratio of 790:660 may represent the length 302 to the length 402. However, it is understood that other ratios may be implemented, including a 1:1 ratio.

Figure 5:
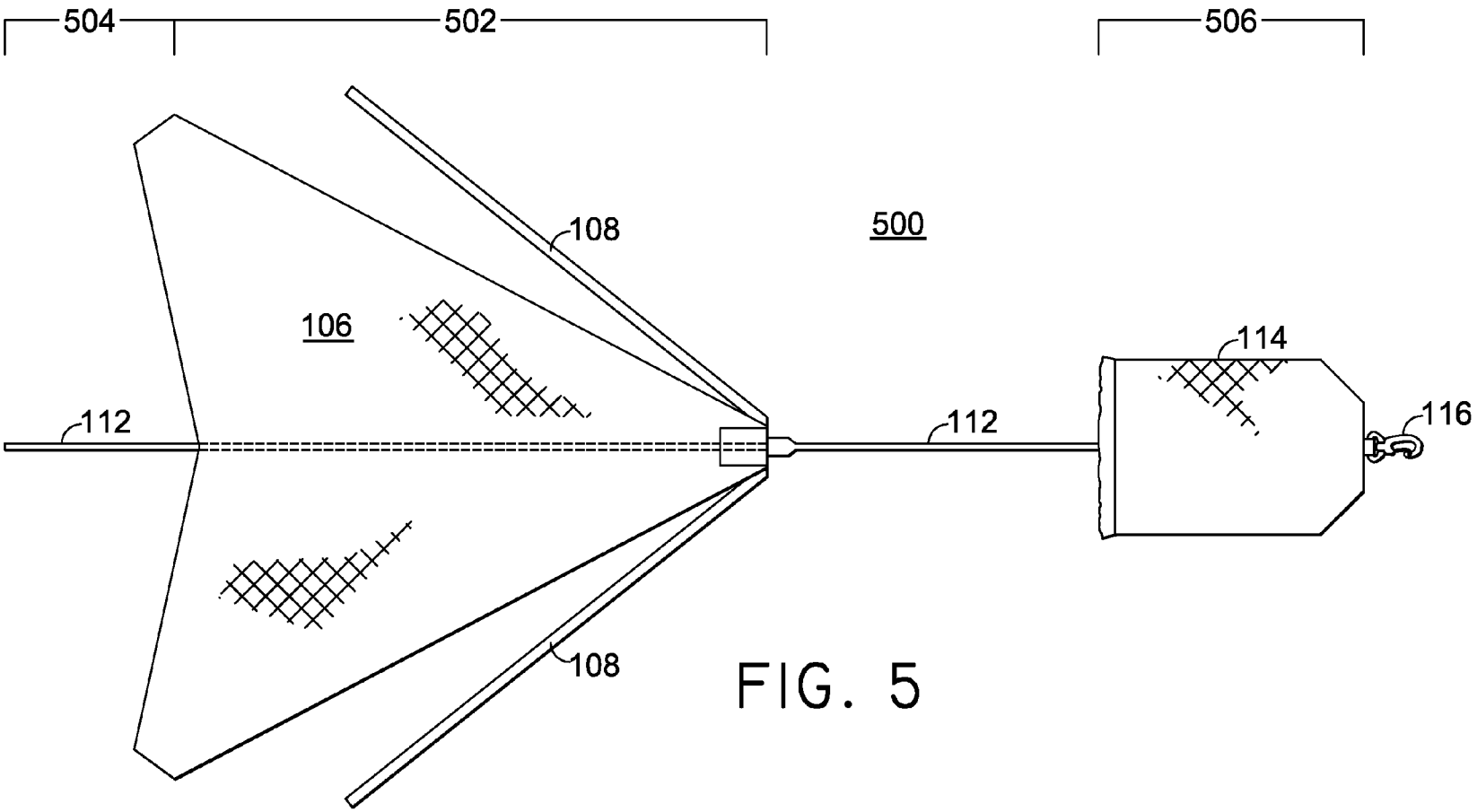
FIG. 5 depicts a force transmission assembly in accordance with embodiments of the present invention.

FIG. 5 depicts a force transmission assembly 500 in accordance with embodiments of the present invention. The force transmission assembly 500 includes members that may transmit a force from a canopy to an athlete in an embodiment. The force transmission assembly 500 includes a connecting member 116, leash 112, a bag 114, a swept wing portion 106, and a veil webbing portion 108.

In the exemplary force transmission assembly 500, the leash 112 extends from the connecting member 116 to a canopy (not shown). An end of the leash 112 proximate to the connecting member 116 is a proximal end. An end of the leash 112 proximate a canopy is a distal end. The leash 112 includes various portions along a length extending from the proximal end to the distal end of the leash 112. For example, a bag portion 506 of the leash 112 extends from the connecting member 116 to an open-end edge of the bag 114. The bag portion 114 extends through an inner portion or cavity in the interior of the bag 114. An additional portion of the leash 112 is a veil portion 502. The veil portion 502 extends from a proximal end to a medial distal end of the swept wing portion 106. A third portion of the leash 112 is a distal portion 504. The distal portion extends from the medial distal end of the swept wing portion 106 to a distal end of the leash 112.

In an exemplary embodiments, the leash 112 is coupled (e.g., stitched, bonded, adhered, fused, welded, tacked, snapped, maintained, etc) to the connecting member 116, the bag 114, a veil, and a canopy. However, in an exemplary embodiment, the leash 112 is connected to any combination of the features discussed herein and/or additional features not discussed herein. Therefore, it is understood that embodiments provided herein are not exhaustive and additional arrangements are contemplated within the scope of the present invention.

Figure 6:
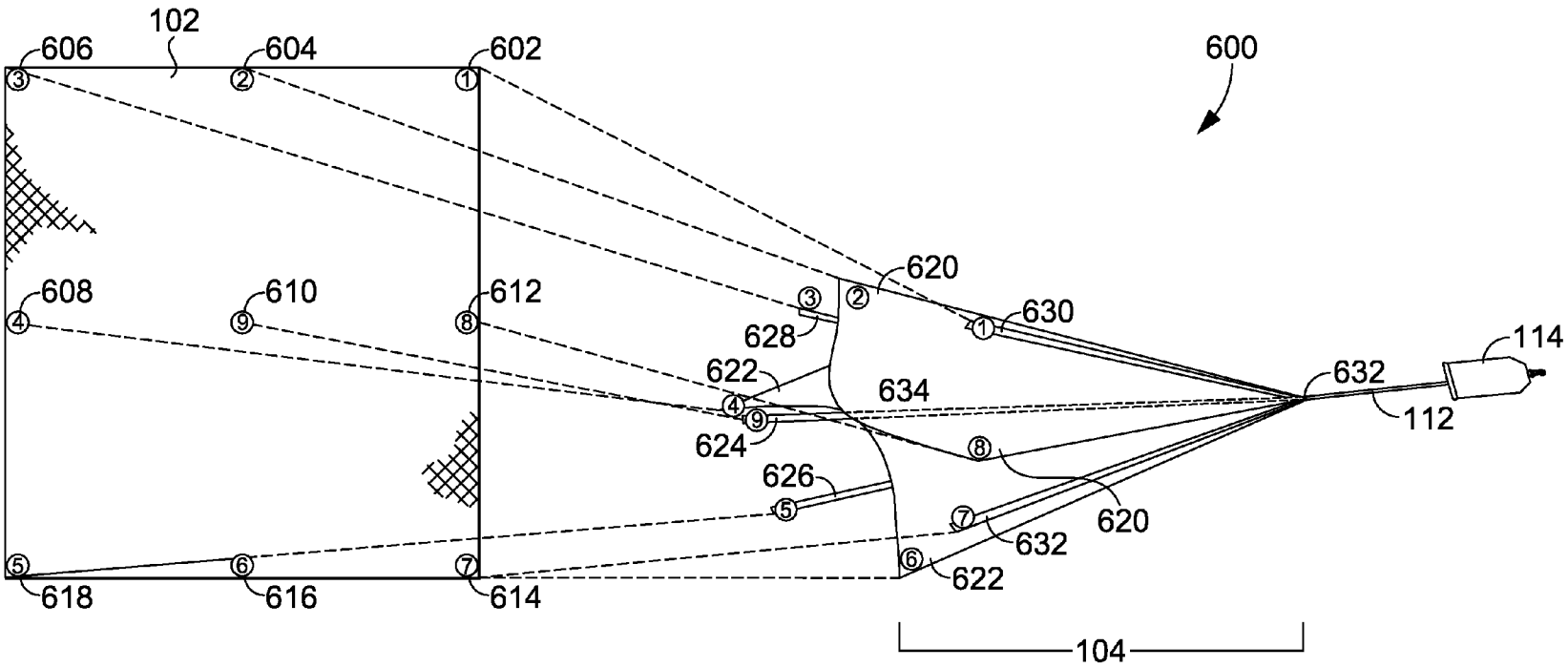
FIG. 6 depicts an exemplary coupling scheme for coupling a veil to a canopy in accordance with an embodiment of the present invention.

FIG. 6 depicts an exemplary coupling scheme 600 for coupling a veil 104 to a canopy 102 in accordance with an embodiment of the present invention. In this example, the veil 104 includes a leash 112. Additionally, the veil 104 is comprised of a first swept wing portion 620, a second swept wing portion 622, a first veil webbing portion 626, a second veil webbing portion 628, a third veil webbing portion 630, a fourth veil webbing portion 632, and a distal portion 624 of the leash 112. In an exemplary embodiment, the first veil webbing portion 626 and the second veil webbing portion 630 are a continuous webbing element. Similarly, in an exemplary embodiment, the second veil webbing portion 628 and the fourth veil webbing portion 632 are a continuous webbing element.

In this exemplary embodiment, the veil 102 is a rectangular structure having a first edge, a second edge, a third edge, and a fourth edge. A perimeter of the canopy 102 is defined by the outer edges of the first edge, the second edge, the third edge, and the fourth edge. However, in additional exemplary embodiments, a perimeter is defined by any combination of edges. For example, a circular canopy is defined by a continuous edge identifiable by the circumference of the circular canopy. Similarly, a polygon having "n" number of edges has a perimeter defined by the "n" number of edges. Therefore, a perimeter is a portion of the canopy extending around an outer portion of the canopy. In an exemplary embodiment, a perimeter is defined by a tunnel for maintaining a stiffening member, as will be discussed in more detail hereinafter.

The canopy 102 is coupled to the veil 104 at a number of points across the canopy 102. For example, the canopy has a number of coupling points identified as 602, 604, 606, 608, 610, 612, 614, 616, and 618. In an exemplary embodiment, the veil 104 is coupled to the canopy 102 at corners of the canopy 102 (i.e., 602, 606, 614, and 616) by way of the distal ends of the veil webbing (i.e., 630, 628, 632, and 626). Similarly, midpoints (i.e., 604, 608, 612, and 616) along the perimeter of the canopy 102 are coupled to the veil by way of lateral distal ends of the swept wing portions (i.e., 620, 622). Additionally, a center of the canopy 102 is coupled to the veil by way of a distal end 624 of the leash 112.

A length from a proximal point 632 on the veil 104 to distal ends (e.g., coupling points) of the various components of the veil 104 may vary in length. For example, the distance from proximal point 632 to the distal end 624 of the leash 112 may be longer than other coupling structures of the veil along the perimeter to allow the canopy 102 to maintain a hemispherical type shape when deployed. Additionally, the distance from the proximal point 632 and the lateral distal ends of the swept wing portions 620 and 622 may be longer than the distance from the proximal point 632 to the distal ends of the veil webbing portions 628-632.

As depicted in FIG. 6, the swept wing portions 620 and 622 may be coupled together along a centerline axis running from the proximal point 632 to a medial distal point 634. Consequently, the two swept wing portions 620 and 622, when coupled together along the centerline axis create four vane fins. The leash 112 may be coupled along the centerline axis as well. In an exemplary embodiment, the leash 112, the swept wing portion 620 and 624, and the veil webbing portions 626-632 are coupled together proximate the proximal point 632.

Figure 7:
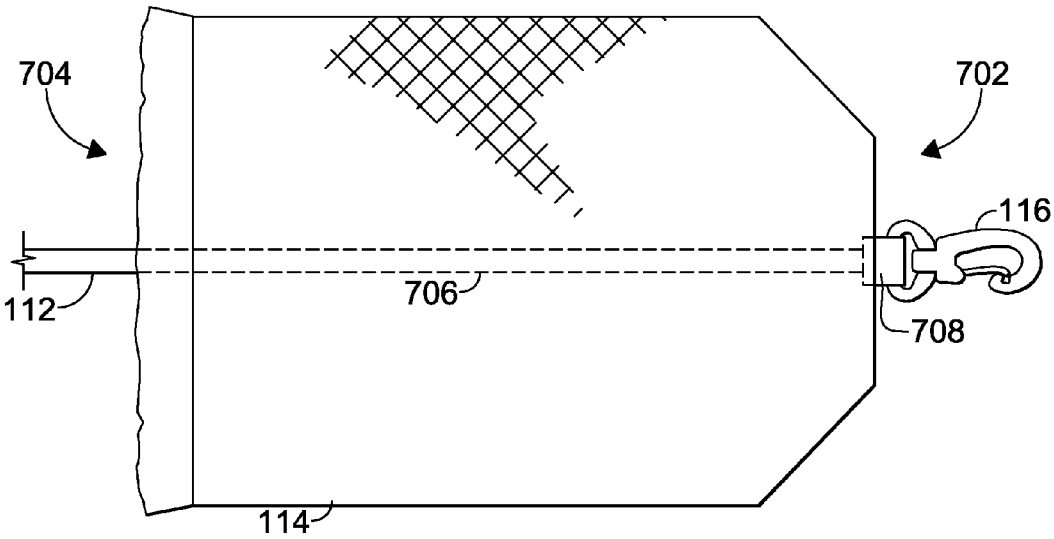
FIG. 7 depicts a bag in accordance with embodiments of the present invention.

FIG. 7 depicts the bag 114 in accordance with embodiments of the present invention. In this exemplary embodiment, the bag 114 has a first end 702 and a second end 704. In an exemplary embodiment, the first end 702 is a closed end. A closed end is an end in which sizeable contents maintained in an inner cavity of the bag 114 may not easily pass through. To the contrary, the second end 704, in an embodiment, may be an open end. An open end is an end in which sizeable contents of the inner cavity of the bag 114 may easily pass through. It is understood at a closure system, such as a drawstring, hook and loop fastener, snaps, buttons, etc., may be implemented to maintain sizeable contents from passing through an open end of the bag 114.

As depicted in FIG. 7, a bag portion 706 of a leash 112 may pass from the first end 702, through the inner cavity of the bag 114, and through the second end 704. For example, in an exemplary manufacturing process of the bag 114, a proximal end of the leash 112 may be stitched in a seam used to create a closed end. Expanding on this example, a portion of webbing 108 may be used to couple a connecting member 116 to the leash 112 and/or the bag 114. Therefore, the leash 112 and/or the webbing portion 708 may pass through a closed end of the bag 114 to allow the connecting member to be coupled to the leash 112. An additional exemplary embodiment has a connecting member 116, which may be a swiveling hook, that is maintained in position by the webbing portion 116. In an exemplary embodiment, the webbing portion 116 and a proximal end of the leash 112 are sewn together, along with the bag 114, proximate to the first end 702.

The bag 114 is functional for storing a leash, a veil, and a canopy of a drag chute. Integration of the bag 114 in line with the leash 112 facilitates and aids in the easy stowing of the remainder of the attached drag chute. Additionally, the bag 114 may provide additional resistance to the movement of an attached athlete. Further, in an exemplary embodiment, coupling the bag 114 in a centerline axis defined by the leash 112 prevents the bag 114 from disrupting the deployment and use of a drag chute by maintaining a position of the bag 114 away from the veil and the canopy. For at least these reasons, an integrated bag that is fixed in a particular location or a particular region (e.g., able to slide along the leash) is beneficial for a drag chute.

In an additional exemplary embodiment, the bag 114 may be reversed (e.g., turned inside out) so that the connecting member 116 is maintained within an inner cavity of the bag 114. In this example, a harness, a belt, or other athlete connecting systems may be stored within the inner cavity of the reversed bag 114. It is contemplated that athlete connecting systems or portions of the drag chute may be maintained in the bag 114 in either a normal orientation and/or a reversed orientation.

FIG. 8 depicts an exemplary stiffening member tunnel 800 cross section view in accordance with embodiments of the present invention. The stiffening member tunnel 800, in an exemplary embodiment, extends at least partially around a perimeter of a drag chute canopy. The stiffening tunnel 800 may define the perimeter or outer edge(s) of a canopy. The stiffening member tunnel 800 includes an internal cavity 802 (e.g., tunnel) for maintaining a stiffening member 804 proximate the perimeter of a canopy.

Formation of the stiffening member tunnel 800 may be accomplished by way of rolling the canopy onto itself so that a first surface 806 of the canopy forms an interior surface of the internal cavity 802. Additionally, a second surface 808 of the canopy forms the exterior surface of the stiffening member tunnel 800. It is also contemplated that the stiffening member tunnel, in an exemplary embodiment, is a discrete member (e.g., tube) that is then coupled to at least a portion of the perimeter of a canopy.

The stiffening member 804 may be any geometric shape (e.g., cross section, length, width, depth, etc). In an exemplary embodiment, the stiffening member is a foam material. For example, the stiffening member 804 may be closed cell foam. Further, in an exemplary embodiment, the stiffening member may be a tubular shaped member. For example, the stiffening member may be a 15 millimeter diameter tubular closed cell foam. The stiffening member, in an exemplary embodiment, is a material having a density between 1.5 and 2 kilograms per cubic meter. In an embodiment, a density within this range allows the canopy to deploy without the stiffening member "weighing" down the perimeter of the canopy and potentially affecting deployment of the canopy.

As previously discussed, a stiffening member may be a semi-rigid material capable of being packed within a bag, such as the bag 114, but provides enough force to allow fast deployment of a drag chute. For example, a canopy with a stiffening member around at least two adjacent sides may allow the canopy to open sooner and therefore generate a pressure differential that results in a desired resistive force. In an exemplary embodiment, a stiffening member aids in opening a windward side of a canopy for deployment of a drag chute. Additional examples contemplated herein for the stiffening member 804 may include members constructed from plastic, polymers, rubber, urethane, silicone, thread, rope, extruded materials, injected materials, cured materials, and/or the like.

As depicted in FIG. 8, the stiffening member 804 may be freely disposed within the internal cavity 802. For example, the stiffening member is free to rotate, slide, or otherwise move within the confines of the internal cavity 802. In an additional embodiment, the stiffening member may be connected to a portion of the canopy. For example, at various coupling points where a veil is coupled to a canopy along a perimeter, a connection technique (stitching, adhering, welding, etc.) may connect the veil to the canopy while also engaging at least a portion of the stiffening member 804

In additional exemplary embodiments, the stiffening member 804 maintains a drag chute in a deployed state. For example, one or more creases or bends may form within a canopy as a result of coupling points on the canopy. The stiffening member 804 may assist in maintaining a separation of edges of the canopy to allow air to enter a cavity defined by the windward surface of the canopy.

Additionally, in some circumstances, a deployed canopy may begin oscillating or otherwise deviating from a position behind an athlete. This movement may be induced by air on the windward side of the chute "spilling" over the edges of the canopy causing localized changes in air pressure. This localized change in air pressure may cause the canopy to deviate from an intended position. In an exemplary embodiment, a stiffening member allows a deployed canopy to prevent the "spilling" effect. For example, a stiffening member maintained around a perimeter may serve as a barrier or other inhibiting structure to prevent higher pressure air on a windward side from escaping to a leeward side in a non-uniform manner (e.g., "spilling"). Therefore, the stiffening member, in an exemplary embodiment, is effective for maintaining a drag chute in an intended position when deployed.

It is contemplated that a stiffening member coupled to a canopy of a drag chute may provide additional benefits other than those explicitly stated herein. Therefore, the additional benefits are within the scope of the present invention.

The invention claimed is:

1. A drag chute, the drag chute comprising:

a canopy of flexible material having a perimeter, a first surface, and a second surface;

a stiffening member coupled to the canopy along a portion of the canopy perimeter;

a veil attached to the canopy;

a leash attached to the veil, the leash defining a centerline axis; and a bag having an open end, a closed end, and an internal cavity, the bag coupled with the leash such that the centerline axis defined by the leash extends through the internal cavity of the bag from the closed end of the bag through the open end of the bag to the veil and the canopy when the drag chute is in use.

2. The drag chute of claim 1, wherein the canopy is a nylon material having a urethane coating on the second surface.

3. The drag chute of claim 1, wherein the perimeter of the canopy forms a tunnel in which the stiffening member is maintained.

4. The drag chute of claim 1, wherein the stiffening member is a foam material.

5. The drag chute of claim 4, wherein the stiffening member is a closed cell foam material.

6. The drag chute of claim 4, wherein the stiffening member is a foam material having a density between 1.5 and 2 kilograms per cubic meter.

7. The drag chute of claim 1, wherein the stiffening member is coupled to the canopy by way of being maintained within a tunnel of the canopy, the tunnel of the canopy is proximate the canopy perimeter.

8. The drag chute of claim 1, wherein the portion of the canopy perimeter is substantially an entire length of the perimeter.

9. The drag chute of claim 1, wherein the canopy perimeter is a tunnel formed from either the first or the second surface of the canopy connected with either the first or the second surface of the canopy.

10. A drag chute, the drag chute comprising:

a canopy of flexible material having a perimeter defined by a stiffening tunnel;

a stiffening member maintained within the stiffening tunnel of the canopy perimeter;

a veil coupled to the canopy;

a bag having a closed end, an open end, and an internal cavity, wherein a leash is coupled to the bag proximate the closed end of the bag, and the leash extends from the closed end of the bag through the internal cavity of the bag to the open end of the bag when the drag chute is in use; and the leash having a first end and a second end, the leash is coupled to the bag proximate the first end, the leash is coupled to the canopy proximate the second end, and the leash is coupled to the veil along a portion of the leash between the first end and the second end.

11. The drag chute of claim 10, wherein the canopy is rectangular in shape having a first side, a second side, a third side, and a fourth side.

12. The drag chute of claim 11, wherein the stiffening member resists gravitational force that inhibits the drag chute from deploying.

13. The drag chute of claim 11, wherein the stiffening member extends along at least the first side and the second side of the canopy within the stiffening tunnel.

14. The drag chute of claim 11, wherein the stiffening member extends along the first side, the second side, the third side, and the fourth side of the canopy within the stiffening tunnel.

15. The drag chute of claim 10, wherein the stiffening member is at least partially connected to the stiffening tunnel of the canopy.

16. The drag chute of claim 10, wherein the stiffening member is freely disposed within the stiffening tunnel of the canopy.

17. A drag chute, the drag chute comprising;

a canopy of flexible material having a windward side, a leeward side, and a perimeter comprised of a stiffening member tunnel;

a stiffening member maintained in the stiffening member tunnel of the canopy, the stiffening member is a foam material;

a veil comprised of a first swept wing portion, a second swept wing portion, a first veil webbing portion, and a second veil webbing portion, the first swept wing portion, the second swept wing portion, the first veil webbing portion, and the second veil webbing portion each coupled to the canopy;

a bag having an open end, a closed end, and an internal cavity between the closed end and the open end;

a connecting member;

a leash having a first end coupled to the canopy, a second end coupled to the connecting member, and a leash portion between the first end and the second end coupled to the veil; and the leash extends through the internal cavity of the bag from the closed end of the bag through the open end of the bag to the veil and the canopy when the drag chute is in use.

* * * * *